US009823038B2

(12) United States Patent
Hollars

(10) Patent No.: US 9,823,038 B2
(45) Date of Patent: Nov. 21, 2017

(54) FLETCHING JIG

(71) Applicant: Goat Tuff Products, LLC, Tucson, AZ (US)

(72) Inventor: Anthony S. Hollars, Tucson, AZ (US)

(73) Assignee: GOAT TUFF PRODUCTS, LLC, Tuscon, AZ (US)

( * ) Notice: Subject to any disclaimer, the term of this patent is extended or adjusted under 35 U.S.C. 154(b) by 68 days.

(21) Appl. No.: 14/589,784

(22) Filed: Jan. 5, 2015

(65) Prior Publication Data

US 2015/0192382 A1 Jul. 9, 2015

Related U.S. Application Data

(60) Provisional application No. 61/923,490, filed on Jan. 3, 2014.

(51) Int. Cl.
*F41B 5/14* (2006.01)
*F42B 6/06* (2006.01)

(52) U.S. Cl.
CPC ..... *F41B 5/1446* (2013.01); *F41B 5/14* (2013.01); *F41B 5/143* (2013.01); *F42B 6/06* (2013.01)

(58) Field of Classification Search
CPC ..... F41B 5/14; F41B 5/1446; F41B 5/143; F42B 6/06
USPC ..... 269/38, 279, 63
See application file for complete search history.

(56) References Cited

U.S. PATENT DOCUMENTS 1,896,536 A * 2/1933 Belshaw ..... F41B 5/1446 269/38
2,337,080 A * 12/1943 Bitzenburger ..... B27M 3/22 269/254 R
2,742,064 A * 4/1956 Quist ..... B27M 3/22 269/164
2,869,597 A * 1/1959 Lozon ..... F41B 5/1446 144/2.1
2,881,531 A * 4/1959 Bitzenburger ..... F41B 5/1446 269/38
2,897,860 A * 8/1959 Martin ..... B27M 3/22 269/38
3,015,483 A * 1/1962 Martin ..... F41B 5/1446 269/254 R
4,749,175 A * 6/1988 Grabits ..... B25B 1/20 269/38
5,211,382 A * 5/1993 Finlay ..... F41B 5/1446 269/279
8,286,953 B2 * 10/2012 Barnes ..... F42B 6/06 269/279
8,608,531 B1 * 12/2013 Huang ..... B24B 41/067 451/386
2002/0059926 A1 * 5/2002 Pinto, Jr. ..... F41B 5/143 124/44.5

* cited by examiner

*Primary Examiner* — Monica Carter
*Assistant Examiner* — Seahee Yoon
(74) *Attorney, Agent, or Firm* — Dale F. Regelman; Grossman, Tucker, Perreault & Plfeger PLLC

(57) ABSTRACT

A fletching jig, which includes two support assemblies for an arrow shaft and a vane nest, wherein an arrow shaft disposed on the two support assemblies is aligned with a vane removeably disposed in the vane nest.

7 Claims, 6 Drawing Sheets

FLETCHING JIG

CROSS-REFERENCE TO RELATED APPLICATIONS

This application claims priority to a U.S. Provisional Application having Ser. No. 61/923,490 and filed Jan. 3, 2014.

FIELD OF THE INVENTION

The invention is directed to an apparatus for fixturing an arrow shaft during application of vanes thereto.

BACKGROUND OF THE INVENTION

Using prior art fletching tools, an arrow shaft is positioned using the shaft diameter at one point and the nock at the other point to align the shaft to the fletching. The nock can vary in the way it is glued on or inserted into the shaft as well as the molded nock itself and since it is serving the dual purpose of alignment and rotation for the angular offset of the vanes it allows for inaccurate vane placement on the shaft.

Prior art fletching jigs move a vane clamp or a vane nest each time an additional vane is placed. This leads to inconsistent alignment and angle (helical) placement.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1A:
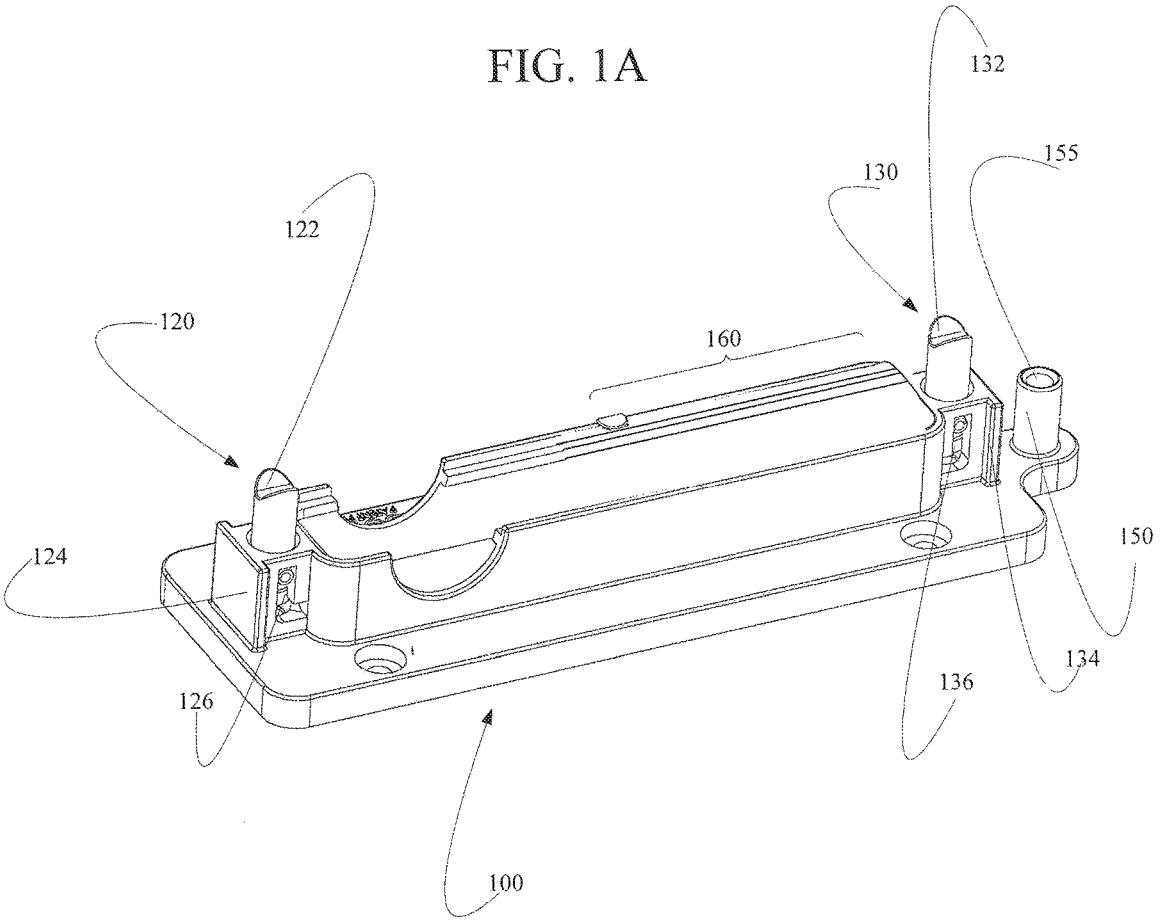
FIG. 1A illustrates a portion 110 of Applicant's fletching jig 100.

FIG. 1A illustrates Applicant's fletching jig 100. In the illustrated embodiment of FIG. 1A, Applicant's fletching jig 100 comprises a front arrow shaft support assembly 120, a rear arrow shaft support assembly 130, a fletcher indexer receiver 150 formed to include an aperture 155 extending downwardly therein. In certain embodiments, a spring is disposed within aperture 155. Fletching jig 110 further comprises a nest receiver 160 (FIG. 1A).

Arrow shaft support assembly 120 comprises a housing 124 and an arrow shaft receiver 122 moveably disposed within housing 124. In certain embodiments, a spring is disposed within housing 124 beneath a distal end of arrow shaft receiver 122. In the illustrated embodiment of FIG. 1A, a proximal portion of arrow shaft receiver 122 comprises a "Vee" shape.

Arrow shaft support assembly 130 comprises a housing 134 and an arrow shaft receiver 132 moveably disposed within housing 134. In certain embodiments, a spring is disposed within housing 134 beneath a distal end of arrow shaft receiver 132. In the illustrated embodiment of FIG. 1A, a proximal portion of arrow shaft receiver 132 comprises a Vee shape.

A downward force on an arrow shaft disposed on the two support assemblies causes the arrow shaft receiver portion of each support assembly to retract into its housing. In certain embodiments, when the downward force is removed, springs disposed in housings 124 and 134 urge both arrow shaft receivers upwardly to their original position.

Figure 1B:
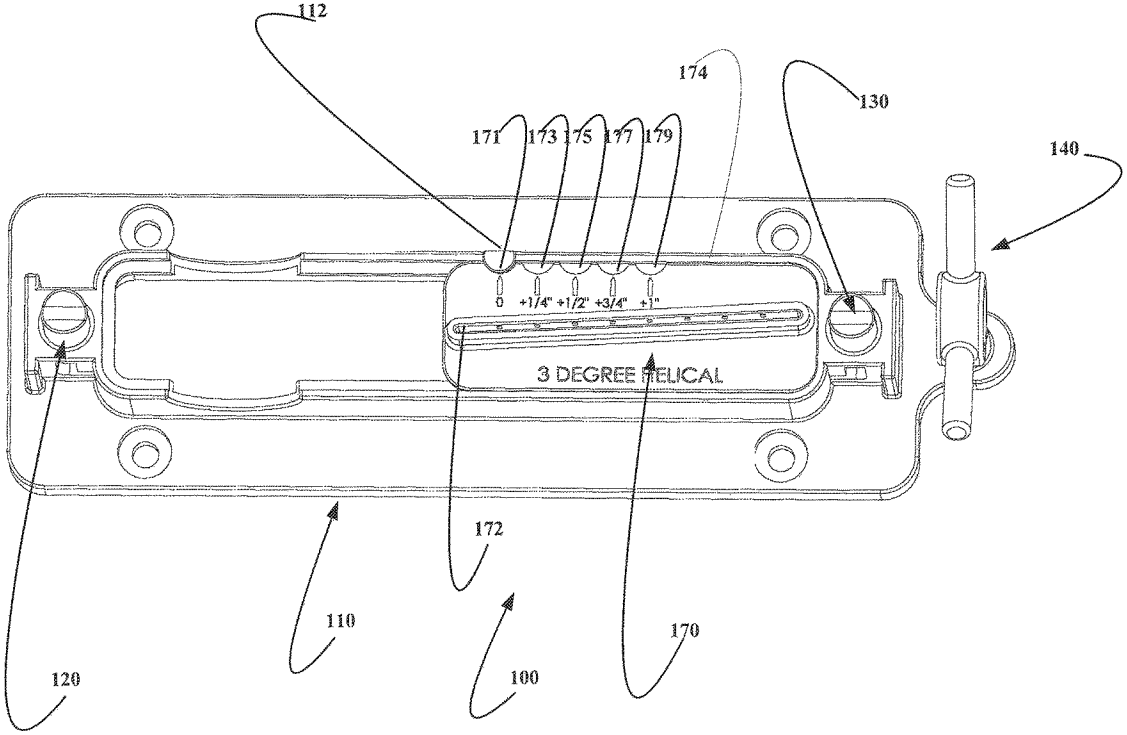
FIG. 1B illustrates one embodiment of Applicant's fletching jig 100.

FIG. 1B illustrates Applicant's fletching jig which includes a vane nest 170 removeably disposed in nest receiver 160. Applicant's fletching jig 100 further comprises a nest positioner 112. In the illustrated embodiment of FIG. 1B, nest positioner. 112 comprises a semi-circular member. Vane nest 170 is formed to include a plurality of notches in a portion of side 174. In the illustrated embodiment of FIG. 1B, notches 171, 173, 175, 177, and 179, correspond to an offset distance of a fletching from an initial distance from an arrow nock of 0 inches, ¼ inch, ½ inch, ¾ inch, and 1 inch, respectively. These notches are used to form an initial offset that varies between different nock manufactures. The fractional inches recited are not an actual distance, just a relational distance. In order for vane nest 170 to fit within nest receiver 160 (FIG. 1A), nest positioner must be aligned with one of the plurality of notches 171, 173, 175, 177, or 179. In the illustrated embodiment of FIG. 1B, nest positioner 112 is shown removeably inserted into notch 171.

Vane nest 170 is further formed to include a vane receiver 172. Vane receiver 172 is configured such that a fletching vane can be inserted therein such that a base portion of the vane extends outwardly from vane nest 170.

Figure 1C:
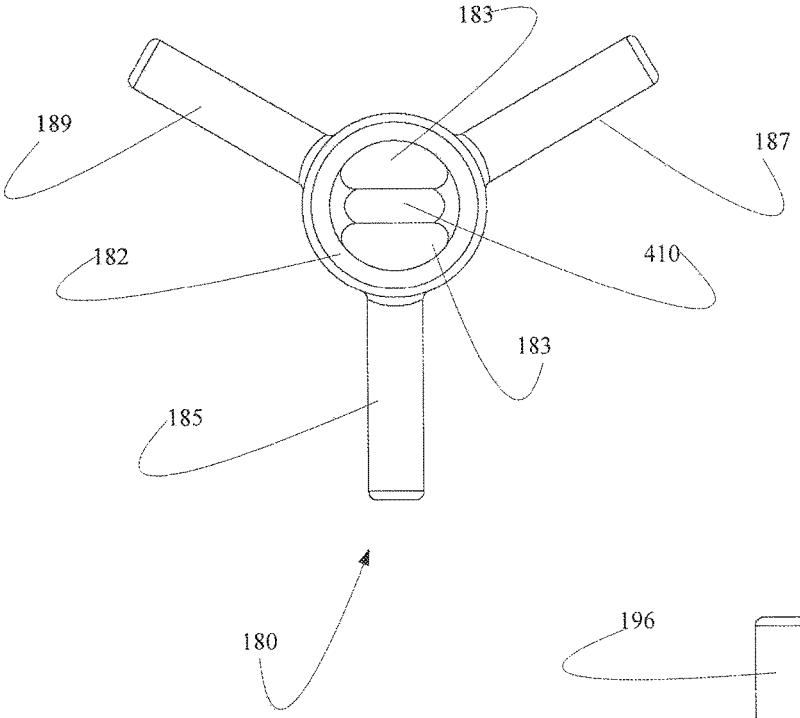
FIG. 1C illustrates Applicant's three-fletch indexer.

FIG. 1C shows Applicant's three-fletch indexer 180. Three fletch indexer 180 comprises a tubular body 182 formed to include an aperture 183 extending therethrough. A nock pin 410 is disposed in a portion of aperture 183. The diameter of aperture 183 is configured to allow three-fletch indexer to be slipped over the nock end of an arrow shaft, and to be snugly attached to that nock end.

Three fletch indexer 180 further comprises a first arrow shaft positioning member 185 attached to tubular body 182 and extending outwardly therefrom. In certain embodiments, positioning member 185 comprises a cylindrical member.

Three fletch indexer 180 further comprises a second arrow shaft positioning member 187 attached to tubular body 182 and extending outwardly therefrom. In certain embodiments, positioning member 187 comprises a cylindrical member.

Three fletch indexer 180 further comprises a third arrow shaft positioning member 189 attached to tubular body 182 and extending outwardly therefrom. In certain embodiments, positioning member 189 comprises a cylindrical member.

Figure 1D:
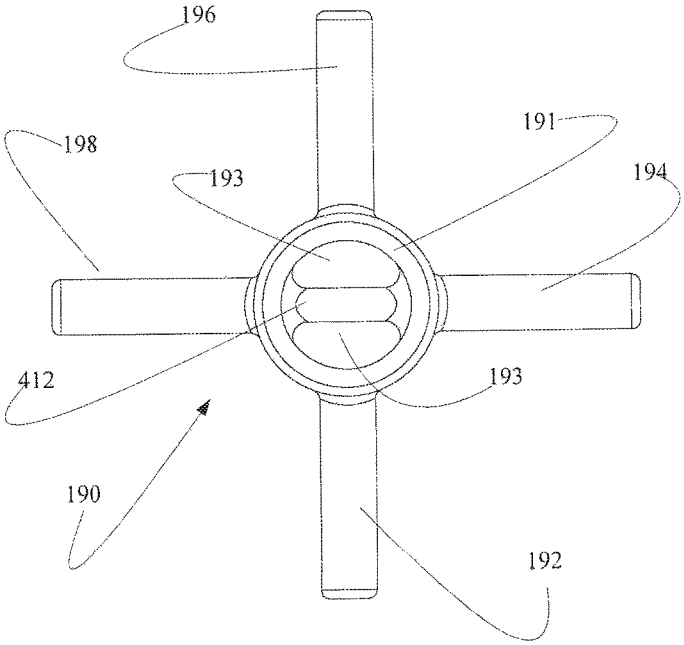
FIG. 1D illustrates Applicant's four-fletch indexer.

FIG. 1D shows Applicant's four-fletch indexer 190. Four fletch indexer 190 comprises a tubular body 191 formed to include an aperture 193 extending therethrough. Nock pin 412 is disposed within aperture 193. The diameter of aperture 193 is configured to allow four-fletch indexer to be slipped over the nock end of an arrow shaft, and to be snugly attached to that nock end.

Four fletch indexer 190 further comprises a first arrow shaft positioning member 192 attached to tubular body 191 and extending outwardly therefrom. In certain embodiments, positioning member 192 comprises a cylindrical member.

Four fletch indexer 190 further comprises a second arrow shaft positioning member 194 attached to tubular body 191 and extending outwardly therefrom. In certain embodiments, positioning member 194 comprises a cylindrical member.

Four fletch indexer 190 further comprises a third arrow shaft positioning member 196 attached to tubular body 191 and extending outwardly therefrom. In certain embodiments, positioning member 196 comprises a cylindrical member.

Four fletch indexer 190 further comprises a fourth arrow shaft positioning member 198 attached to tubular body 191 and extending outwardly therefrom. In certain embodiments, positioning member 198 comprises a cylindrical member.

Figure 2:
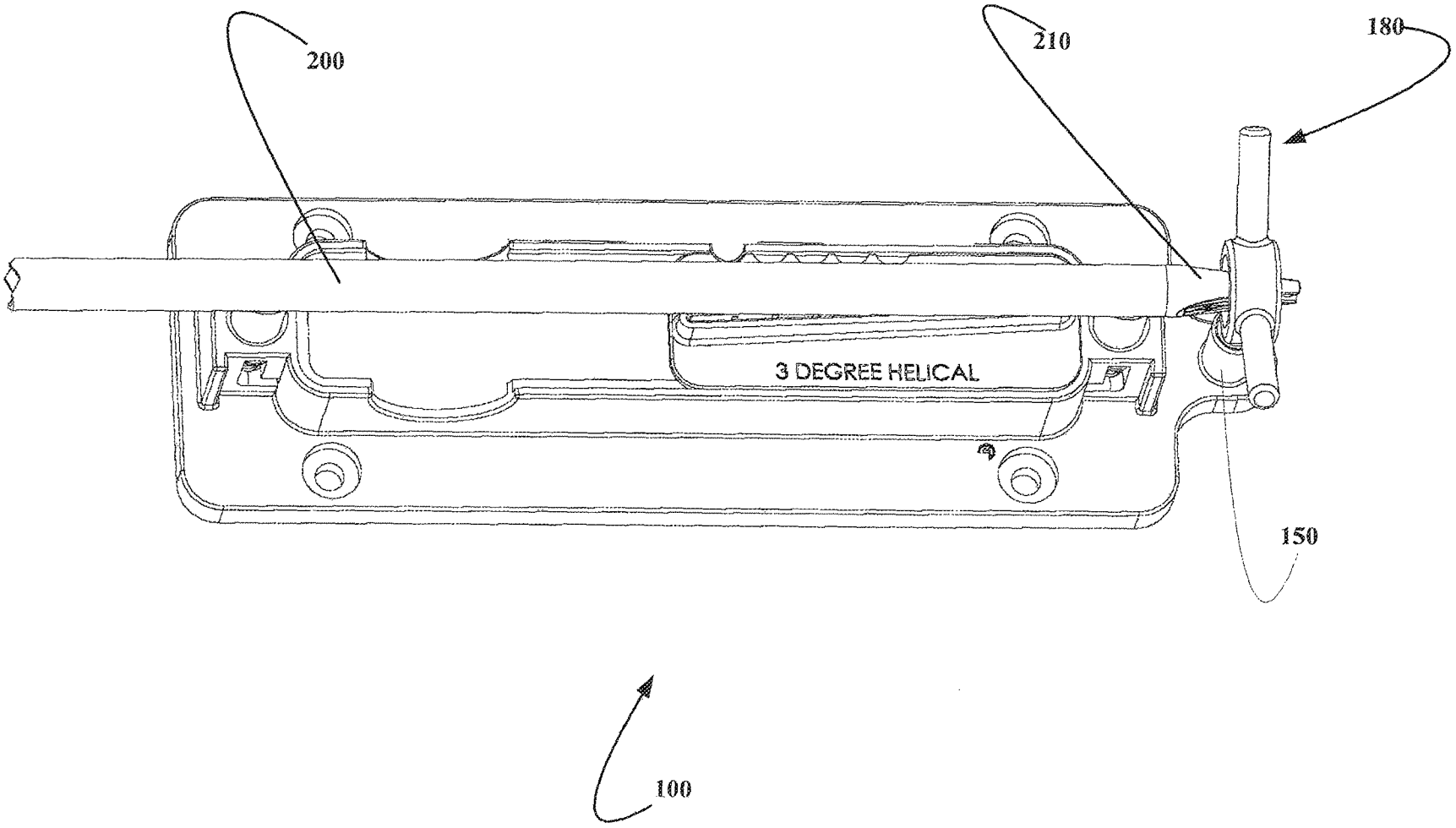
FIG. 2 shows an arrow shaft removeably disposed on Applicant's fletching jig 100.

FIG. 2 shows an arrow shaft 200 removeably attached to fletching jig 100. Nock 210 of arrow shaft 200 extends into three-fletch indexer 180 such that nock 210 engages nock pin 410 (FIG. 1C). In the illustrated embodiment of FIG. 2, first arrow positioning member 185 (FIG. 1C) is removeably inserted into aperture 155 formed in fletcher indexer receiver 150.

Figure 3:
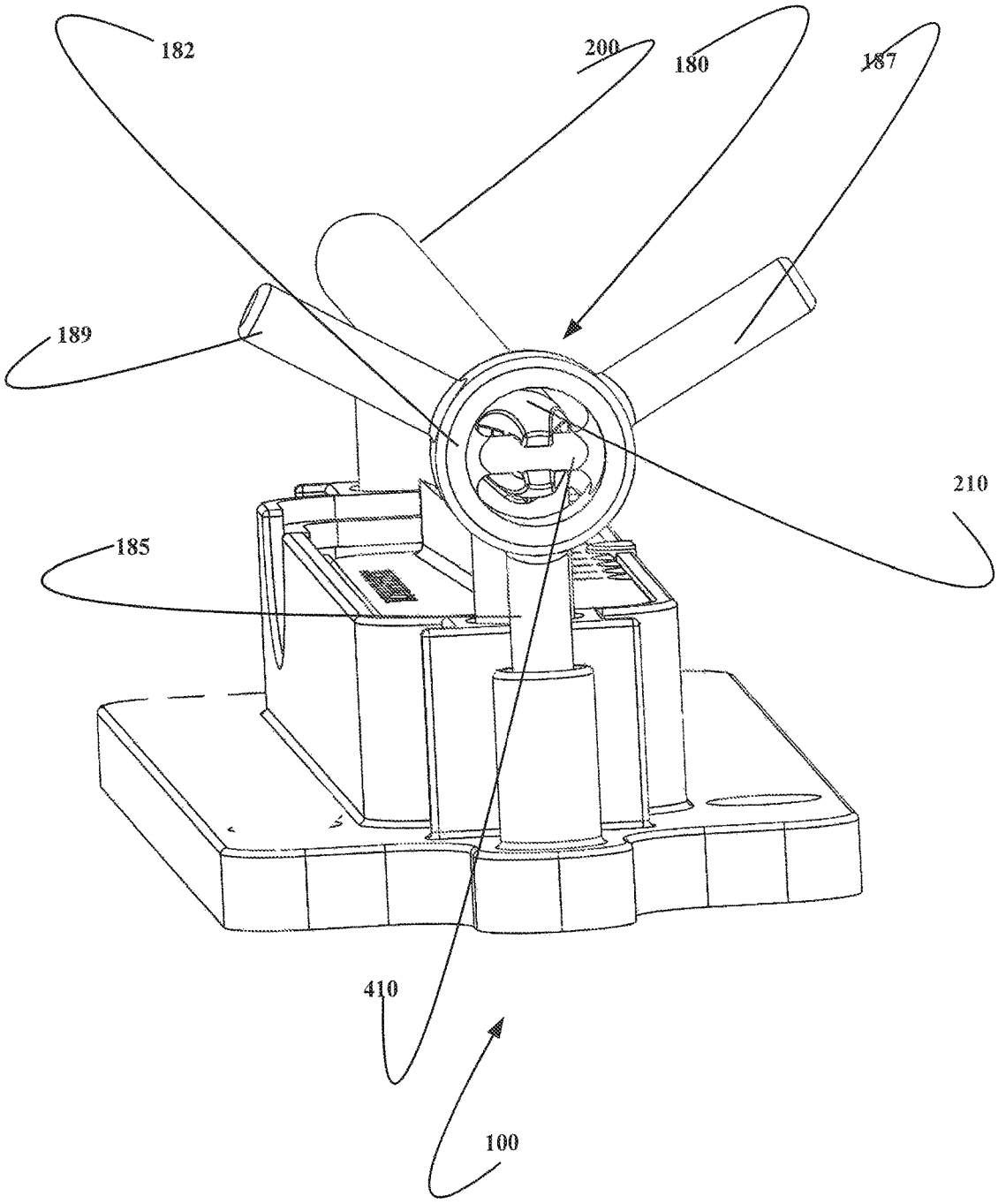
FIG. 3 shows end 210 of an arrow shaft releaseably attached to Applicant's three-fletch indexer.

In the illustrated embodiment of FIG. 3, nock pin 410 extends inwardly from cylindrical body 182 into aperture 183 to releaseably attach nock 210 to nock pin 410. In certain embodiments, nock pin 410 is a separate assembly and is only used for angular offset of the vanes.

Applicant has found that an arrow shaft is the only truly consistent part of the arrow that can be used for alignment of the vanes. Using fletching jig 100, only the front and rear Vee blocks 120 and 130 contact arrow shaft 200. The vane nests all fit into the same block as the Vee posts and do not move from that position during the placement of all of the vanes on the arrow shaft.

Applicant's fletching jig 100 is easy to use due to the fact that the shaft is placed to the vane and not vice-versa. This allows total control in the gluing process with out worry about the assembly of the parts of the fletcher with glue applied to the vane which is the case with all prior art fletchers.

Figure 4:
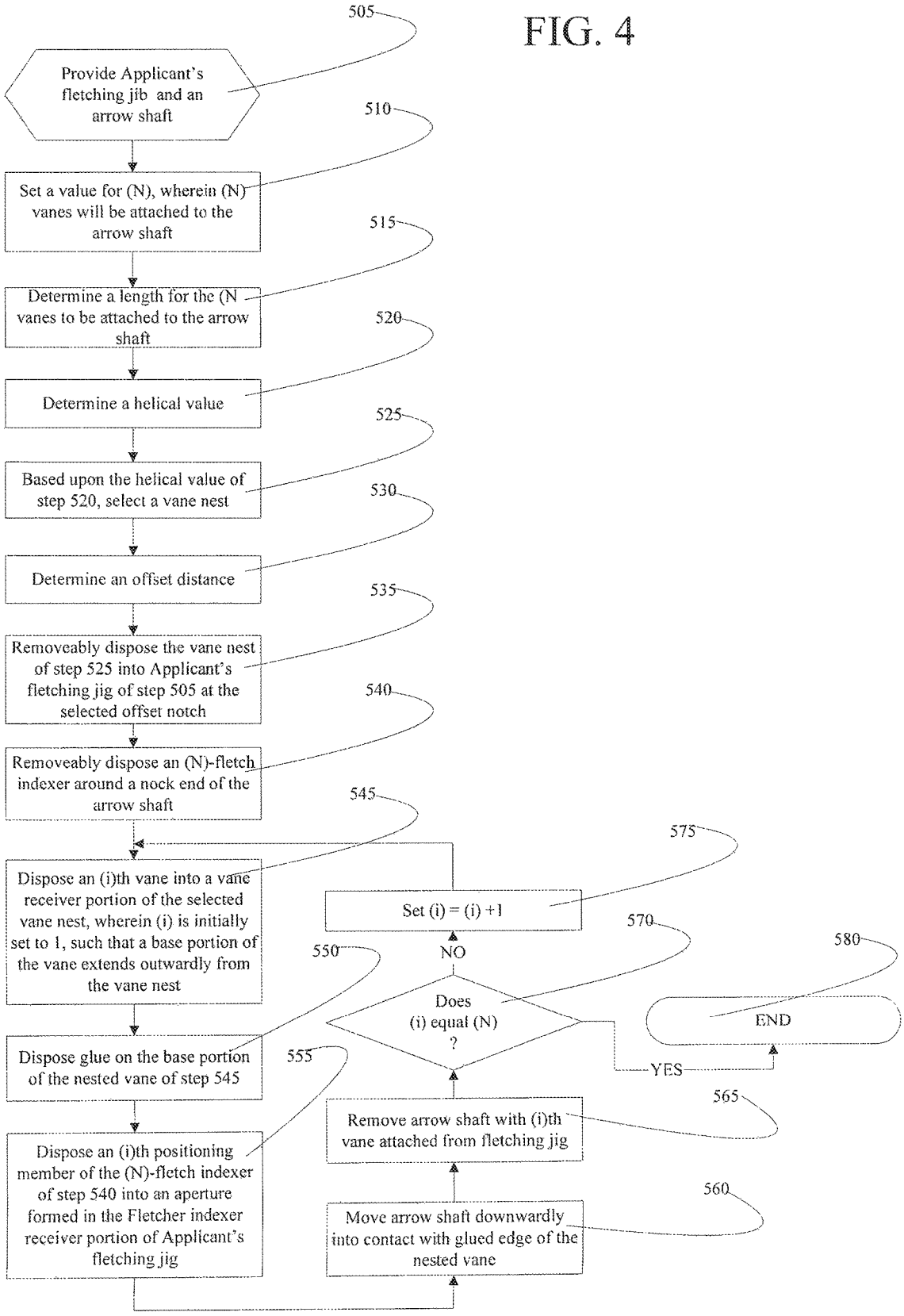
FIG. 4 is a flow chart summarizing Applicant's method using Applicant's apparatus.

FIG. 4 summarizes Applicant's method using Applicant's fletching jig. In summary, Applicant's method: (i) places a vane into a nest and glue is applied to a base portion of the vane, (ii) an arrow shaft, in optional combination with a vane indexer, is then set down on the Vee blocks with an indexer positioning member engaged in it's post hole, (iii) the arrow shaft is urged downwardly into contact with the glued vane to attach the vane to the shaft.

Referring now to FIG. 4, in step 505 the method provides Applicant's fletching jig 100, and an arrow shaft. In step 510, the method determines a number (N) of vanes to attach to the arrow shaft, wherein (N) is greater than 1. In certain embodiments, (N) is 2. In other embodiments, (N) is up to 6.

In step 515, the method determines a length for the (N) vanes. In step 520, the method determines a helical value. As those skilled in the art will appreciate, an arrow with a "straight fletch," does not cause rotation in flight.

On the other hand, an arrow with a helical fletch does rotate in flight. A helical fletch gives superior broadhead flight and better long-distance accuracy. A disadvantage is a decrease in arrow velocity.

Based upon the selected vane length of step 515 and the selected helical value of step 520, the method selects a vane nest in step 525. In certain embodiments, Applicant's fletching jig includes four (4) vane nests, namely a ½ degree, a 1 degree, a 2 degree, and a 3 degree, vane nest. The ¼ degree Vane Nest can be used with vanes up to 4 inches long. This helical value is also recommended for most crossbow arrows.

The 1 degree Vane Nest can be used with vanes up to 4" long. The 2 degree Vane Nest can be used for vanes up to 3.25" long. The 3 degree Vane Nest can be used for vanes up to 2.25" long.

In step 530, the method selects an offset distance. In step 535, the method removeably disposes the selected vane nest of step 525 into Applicant's fletching jig at the appropriate offset notch.

In step 540, the method removeably disposes an (N)-fletch indexer around a nock end of the arrow shaft of step 505. In certain embodiments, (N) is 3 and three-fletch indexer 180 (FIG. 1C) is used. In certain embodiments, (N) is 4 and four-fletch indexer 190 (FIG. 1D) is used.

In step 545, the method disposes an (i)th vane into a vane received portion of the selected vane nest. Initially, (i) is set to 1. The first time through the algorithm of FIG. 5, a first vane is disposed in the selected vane nest such that a base portion of the vane extends outwardly from that vane nest.

In step 550, the method disposes an adhesive on a base portion of the nested vane of step 545. In step 555, the method disposes an (i)th positioning member of the (N)-fletch indexer attached to the arrow shaft into an aperture formed in the fletcher indexer receiver portion of Applicant's fletching jig. For example and without limitation, if three-fletch indexer 180 is being utilized, in the first iteration of Applicant's method, positioning member 185 (FIG. IC) is inserted into aperture 155 (FIG. 1A) formed in fletcher indexer receiver 150 (FIG. 1A). In a second iteration, positioning member 187 (FIG. 1C) is inserted into aperture 155. This effectively rotates the arrow shaft having a first vane attached 120 degrees for placement of a second vane. In a third iteration, positioning member 189 (FIG. 1C) is inserted into aperture 155. This effectively rotates the arrow shat having two vanes attached an additional 120 degrees for placement of a third and final vane.

In step 560, the method urges the arrow shaft mounted in Applicant's fletching jig downwardly such that the shaft contacts the glued edge of the nested vane, thereby attaching the nested vane to the arrow shaft. In step 565, the method removes the arrow shaft having an (i)th vane attached hereto.

In step 570, the method determines if (i) equals (N). If (i) does equal (N), then all (N) vanes have been attached to the arrow shaft, and the method ends at step 580. Alternatively, if (i) does not equal (N), then additional vanes still need to be attached to the arrow shaft, and the method transitions from step 570 to step 575 wherein the method increments (i) by 1, i.e. sets (i) equal to (i)+1. The method transitions from step 575 to step 545 and continues as described herein.

While the preferred embodiments of the present invention have been illustrated in detail, it should be apparent that modifications and adaptations to those embodiments may occur to one skilled in the art without departing from the scope of the present invention as set forth herein.

I claim:

1. A fletching jig, comprising:

a vane nest receiver;

a vane nest removeably disposed in said vane nest receiver;

a first arrow shaft assembly comprising a first housing and a first arrow shaft receiver, wherein said first arrow shaft receiver extends outwardly from said first housing; and a second arrow shaft assembly comprising a second housing and a second arrow shaft receiver, wherein said second arrow shaft receiver extends outwardly from said second housing;

wherein said first arrow shaft receiver and said second arrow shaft receiver are configured such that an arrow shaft disposed on said first arrow shaft receiver and said second arrow shaft receiver is disposed above said vane nest.

2. The fletching jig of claim 1, wherein each of a plurality of differing vane nests can be removeably disposed in said vane nest receiver.

3. The fletching jig of claim 2, wherein a 1 degree vane nest can be used with vanes up to 4" long.

4. The fletching jig of claim 2, wherein a 2 degree vane nest can be used for vanes up to 3.25" long.

5. The fletching jig of claim 2, wherein a 3 degree vane nest can be used for vanes up to 2.25" long.

6. The fletching jig of claim 1, wherein said vane nest can be moved to fletch at different distances from an arrow nock.

7. The fletching jig of claim 1, wherein:

the arrow shaft receiver of each of the first and second arrow shaft assemblies is moveably disposed within said housing of each of the first and second arrow shaft;

a downward force on an arrow shaft disposed on the first and second arrow shaft assemblies causes the arrow shaft receiver of each of the first and second arrow shaft assemblies to retract into said housing.

* * * * *